US005403543A

United States Patent [19]

Okutomi et al.

[11] Patent Number: 5,403,543

[45] Date of Patent: Apr. 4, 1995

[54] PROCESS FOR MANUFACTURING A CONTACT MATERIAL FOR VACUUM CIRCUIT BREAKERS

[75] Inventors: Tsutomu Okutomi; Tsuneyo Seki; Atsushi Yamamoto; Mikio Okawa; Tadaaki Sekiguchi; Yoshiko Majima, all of Tokyo, Japan

[73] Assignee: Kabushiki Kaisha Toshiba, Tokyo, Japan

[21] Appl. No.: 893,017

[22] Filed: Jun. 3, 1992

[30] Foreign Application Priority Data

Jul. 5, 1991 [JP] Japan ..... 3-164922

[51] Int. Cl.[6] ..... B22F 1/00; B22F 3/00

[52] U.S. Cl. ..... 419/23; 419/31; 419/33; 419/46; 75/247; 75/623; 252/514

[58] Field of Search ..... 75/245, 623, 369, 255, 75/246, 247, 243; 252/514; 419/2, 11, 31, 32, 33, 46, 53, 55, 23; 148/513, 423; 420/495, 499, 500, 501, 428

[56] References Cited

U.S. PATENT DOCUMENTS

| | | | |
|---|---|---|---|
| 2,850,378 | 9/1958 | Cooper | 75/623 |
| 3,945,863 | 3/1976 | Precht | 419/23 |
| 4,048,117 | 9/1977 | Emmerich | 252/513 |
| 4,170,467 | 10/1979 | Kaito et al. | 75/512 |
| 4,207,120 | 6/1980 | Armstrong et al. | 419/3 |
| 4,209,320 | 6/1980 | Kajinaga et al. | 75/345 |
| 4,722,826 | 2/1988 | Poole | 419/11 |
| 4,777,335 | 10/1988 | Okutomi et al. | 200/264 |
| 4,830,821 | 5/1989 | Okutomi et al. | 419/25 |
| 5,011,798 | 4/1991 | Sasabe et al. | 501/87 |
| 5,130,068 | 7/1992 | Naya et al. | 264/61 |

FOREIGN PATENT DOCUMENTS

| | | |
|---|---|---|
| 0426375 | 5/1991 | European Pat. Off. . |
| 1113364 | 3/1956 | France . |
| 2240493 | 3/1974 | Germany . |
| 2346179 | 6/1975 | Germany . |
| 2521504 | 12/1975 | Germany . |
| 2619459 | 12/1977 | Germany . |
| 62-76219 | 4/1987 | Japan . |

OTHER PUBLICATIONS

IEEE Transactions on Components, Hybrids, and Manufacturing Technology, vol. 14, No. 2, Jun. 1991.

*Primary Examiner*—Ngoclan T. Mai

*Attorney, Agent, or Firm*—Oblon, Spivak, McClelland, Maier & Neustadt

[57] ABSTRACT

Disclosed is a manufacturing process of an alloy material comprising a chromium component and a base component which comprises at least one element selected from tile group consisting of copper and silver, the manufacturing process comprising steps of: subjecting a chromium material with a carbon material to heat treatment; and manufacturing the alloy material using the chromium material treated at the heat treatment subjecting step and a raw material for tile base component. At the heat treatment subjecting step, the chromium material, mixed with 50 ppm to 5,000 ppm of the carbon material, is heated to a temperature within the range of 800° C. to 1,400° C. in a non-oxidizing atmosphere. According to this manufacturing process, the level of oxygen content in the alloy material are decreased to be not more than 200 ppm. The obtained alloy material can be used as a contact material for vacuum circuit breakers.

15 Claims, 1 Drawing Sheet

PROCESS FOR MANUFACTURING A CONTACT MATERIAL FOR VACUUM CIRCUIT BREAKERS

BACKGROUND OF THE INVENTION

1. Field of the Invention

The present invention relates to a process for manufacturing a contact material for vacuum circuit breakers, and in particular to a manufacturing process by which a contact material having a lower restriking frequency can be obtained.

2. Description of the Prior Art

Contact materials for vacuum circuit breakers are basically required to have excellent material characteristics such as a weld resistant property, an ability to withstand voltages applied to the contact materials and an ability to completely break current without restriking and igniting. However, it is difficult to satisfactorily meet all of the requirements, because the physical nature of these requirements contradict one another. As a result, when the contact material is being manufactured, priority, as according to the particular circuit breaker, is given to the most important requirement for application to the circuit breaker at the sacrifice of the other requirements.

An example of a prior art electrode contact for a vacuum circuit breaker having a large capacity can be found in Japanese Patent Publication No. 41-12131, which discloses a copper alloy containing a weld inhibitor ingredient such as bismuth, tellurium, tin and the like at an amount of less than 5% by weight. In this connection, since the vacuum circuit breakers have advantages over other circuit breakers in that their bodies are compact and light weight and can be adapted to the environment with less repair, etc., the possible applications of vacuum circuit breakers have been increasing year by year. This has led to a drastic increase in demand for vacuum circuit breakers not only for the popular conventional use in which they are used with circuits at a voltage of less than 36 KV, but also for special uses such as making and breaking a condenser circuit. Therefore, vacuum circuit breakers are now required to have a higher voltage-withstanding property. Unfortunately, the above-mentioned prior art materials are not able to satisfy such recent requirements.

One of the reasons for regarding the voltage withstanding property of the prior art material as being insufficient for use with high-voltages stems from it's tendency to cause restriking and reignition phenomena. Accordingly, in order to improve the reliability of the contact products, it is recognized that these phenomena must be understood. However, the restriking and reignition phenomena have not yet been traced to a direct origin, nor has any technique been developed for preventing the phenomena.

Due to current demands, the contact material is required to have a higher voltage-withstanding property and a lower restriking frequency for use with higher voltages as mentioned above. To improve the voltage withstanding property of the contact material and decrease the restriking frequency, it is preferred to decrease the content of the weld inhibitor ingredient as much as possible and prevent the weld inhibitor ingredient from being particularly disuniformly concentrated in the material. The weld inhibitor makes the material brittle and is therefore disadvantageous to the pressure resistance of the material, the decrease of gaseous impurities and pin holes in the material, and the strengthening of the contact alloy itself. With respect to these points, the above-mentioned prior art Cu-Bi material does not satisfactorily meet the requirements of recent trend.

On the other hand, a sintered copper-tungsten alloy material and a copper-tungsten carbide (Cu-WC) alloy material are known as another conventional contact materials. Despite the fact that these sintered contact alloy materials arc rather remarkable in their voltage withstanding property, they tend to contain pores due to the manufacturing method, thereby causing the sintered material to actively produce thermoelectrons. As a result, this conventional alloy has the defect of easily causing the restriking phenomenon.

Moreover, in the field of vacuum circuit breakers for use with high voltages and heavy currents, a copper-chromium alloy material is utilized for the contact material. In this alloy material, since the difference in the vapour pressures of the component elements is not as large as that of the other materials, this alloy has an advantage in that its properties can be expected to be stable. Accordingly, the characteristics of this contact alloy material may be useful depending upon the manner in which it is used.

The above-mentioned Cu-Cr alloy contact material is generally manufactured according to the process which is disclosed, for example, in Japanese Patent Publication No. 59-30761 as comprising the steps of: mixing Cr powder with a small amount of Cu powder; pouring the mixed powder into a die and pressing the powder slightly to form a compact; taking the compact out from the die and sintering the compact in a vacuum to form a Cr skeleton; and finally infiltrating a Cu component into the Cr skeleton. Moreover, another manufacturing process is disclosed in Laid-Open Japanese Patent Application No.(Kohkai) 59-25903. This reference discloses a method in which a Cu pellet is mounted on a Cr powder being poured into a die. The pellet then infiltrates into the Cr powder after air is removed from the Cr powder and Cu pellet under reduced pressure. Furthermore, the Cu-Cr alloy material can be obtained by a solid-phase sintering method in which Cu powder and Cr powder are first mixed at a desired content and compacted. Then the compact is sintered at a temperature equal to or less than the melting point of the Cu element.

However, in the above-described processes by which the alloy material is generally obtained using a powder metallurgical technique, proper management of the raw material powder, and sintering and infiltration techniques have not yet been developed to adequately cope with the generation of the restriking phenomenon. Therefore, they cannot give satisfactory results with respect to the restriking frequency.

SUMMARY OF THE INVENTION

With these problems in mind, it is therefore an object of the present invention to provide a process for manufacturing contact materials For vacuum circuit breakers by which contact materials having a lower restriking frequency can be obtained.

The foregoing object is accomplished in one embodiment by providing a process for manufacturing a contact material comprising a chromium component and a base component which comprises at least one element selected from the group consisting of copper and silver, the manufacturing process comprising steps of: (A) subjecting a chromium material with a carbon material to heat treatment so as to decrease the content of an oxygenic contaminant in the chromium material; and (B) manufacturing the alloy material using the chromium material treated at the subjecting step (A) and a raw material for the base component.

According to the above construction, the level of oxygenic contaminants in the obtained alloy material are decreased to be less than 200 ppm, and the restriking frequency of the contact material manufactured by the process of the present invention can be drastically reduced,while also having a prominent weld-proof property. Therefore, the process according to the present invention is suitable for manufacturing a contact alloy material for vacuum circuit breakers.

BRIEF DESCRIPTION OF THE DRAWINGS

The features and advantages of the contact material according to the present invention over the proposed materials will be more clearly understood from the following description of the preferred embodiments of the present invention taken in conjunction with the accompanying drawings in which like reference numerals designate the same or similar elements or sections throughout the figures thereof and in which.

DETAILED DESCRIPTION OF THE PREFERRED EMBODIMENTS

Figure 1:
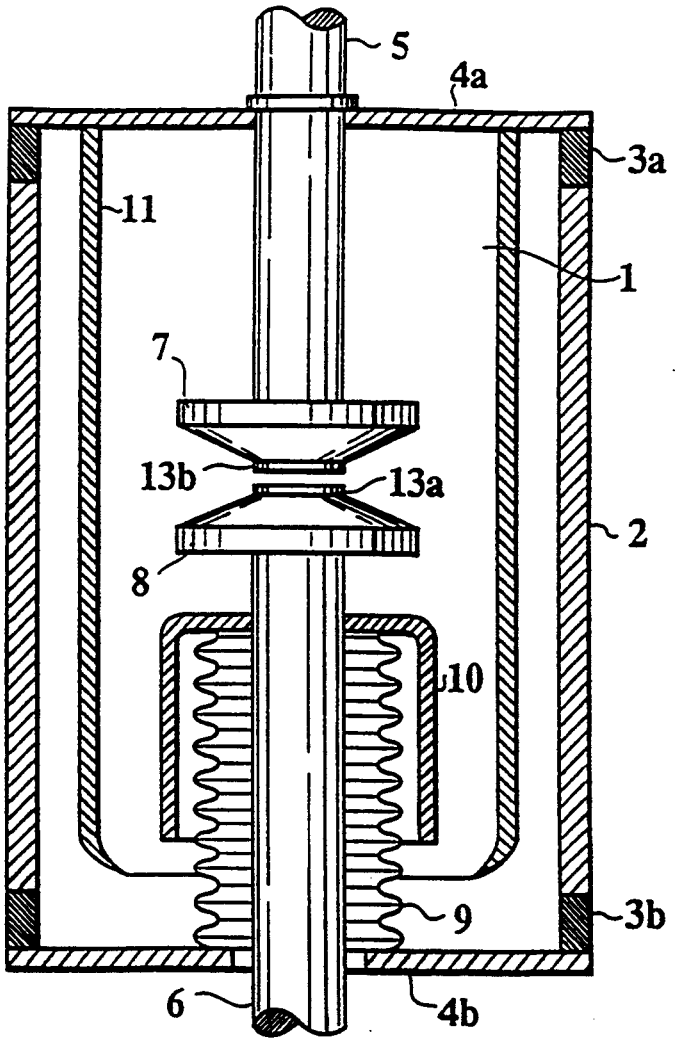
FIG. 1 is a longitudinal sectional view showing an example of a vacuum circuit breaker to which a contact material according to the present invention is adapted.

For quality control of the raw Cr material powder, the present inventor conducted research on the occurrence of gas discharge during heating of the contact material by watching the total amount of discharged gas and the manner in which the gas was discharged. As a result, the inventors found that there is a relationship between these factors and the occurrence of the restriking phenomenon. Specifically, the occurrence of the restriking phenomenon can effectively be prevented by regulating the content of gaseous contaminants which are contained in the contact material and discharged by heat, particularly these gaseous contaminants which are abruptly discharged when heated to a temperature approximate to the melting point of the contact material.

Specifically, while heating the contact material, most of the gaseous impurities absorbed in the contact material are eliminated at a temperature lower than the melting point of the contact material. Then, gaseous impurities dissolved in the contact material are discharged at a temperature approximate to the melting point. By further heating the material above the melting point, a few to several hundred sudden gas discharges are observed in which the gas is discharged in a pulse-like manner for a very short time, for example, for a few msec. The gases produced by these sudden gas discharges include only small amounts of methane, ethane and the like. However, most of the gases are oxygenic contaminants such as oxygen, carbon monooxide, carbon dioxide and the like. From these facts, it is considered that these sudden gas discharges may be caused by the decomposition of metal oxides, and the like, contained in the contact material. Moreover, from the inventors' research, it has been further found that a contact material having a high restriking frequency also tends to frequently encounter sudden gas discharges.

In light of the above, it is supposed that the restriking phenomenon can be prevented by heating the contact material over the melting point so as to discharge the oxygenic gaseous contaminants in advance.

However, the contact material for vacuum circuit breakers contains a considerable amount of a copper component which has a high vapour pressure. On the other hand, the elimination of the oxygenic contaminants by heat decomposition requires a high temperature, for example, a temperature of at least 1,200° C. under a reduced pressure of $10^{-3}$ torr to $10^{-4}$ torr. Accordingly, if a contact material containing a high vapour pressure component is subjected to such heat treatment, its composition may be changed by vaporization. Therefore, this heat treatment is inconvenient for controlling the properties of a contact material which includes a Cu component as an electrically-conductive ingredient and a weld inhibitor ingredient such as bismuth, tellurium and the like.

Moreover, with regards to the Bi component, a raw Bi material violently discharges several kinds of gaseous substances when heated to temperatures of approximately 400° C. to 500° C. A portion of these gaseous substances then combine with the Cu component during heating to produce relatively stable compounds. Further, another portion of these compounds decompose while the contact material is molten. However, the remainder remains in a constant state, thereby causing sudden gas discharges. Even when using a Bi raw material powder having a purity of 99.9999%, if, before manufacturing, the raw material powder is left in a condition where oxidization of or gas absorption in the raw Bi material can occur, the contact material cannot escape sudden gas discharges originating in the Bi material.

From the above-mentioned observations, two requirements are realized with regard to quality control of the contact material containing a weld inhibitor ingredient. Namely, the first requirement is that both the high electrically conductive material and the weld inhibitor ingredient, that is, the Cu component and the Bi component, require individual heat treatments in order to remove the impurities in advance of the manufacturing process. Secondly, contamination caused by gas arising from tools such as crucibles, boats or plates, which are in direct contact with the contact alloy material being partially or entirely fused during the manufacturing process and the heat treatment process, must also be taken into consideration for quality control of the contact material.

In regard to the first requirement, the present inventors ascertained that individual heat treatment of the respective component materials is rather effective in decreasing sudden gas discharges, and additionally noticed a tendency for the restriking frequency to decrease.

With regard to the second requirement, the inventors also ascertained that the material composition and physical and chemical conditions of the surfaces of the tools touching the fused contact material affect the manner in which sudden gas discharges occur, as well as the restriking frequency. At the same time, they recognized that the second requirement is essential because the effect of decreasing the sudden gas discharges by regulating the impurities at the step of preparation of the component raw materials according to the first requirement can certainly and efficiently be further improved by satisfying the second requirement.

in other words, when taking both the first and second requirements into consideration, the effect on the manufactured Cu-Cr alloy grows synergistically in comparison with cases which meet only one requirement. From this feature, it is suggested that total supervision must be performed throughout the entire series of manufacturing steps, and in particular to the method of raw material preparation and cooling after preparation.

In this connection, the contents of the contaminants and the manner of contamination, such as a separable material contained in the mixture, an oxidized surface, precipitation and the like, in the Cu and Cr raw materials are seemingly important for solving the problem of sudden gas discharge.

Specifically, if contaminants in an oxide form are simply mixed in with the raw material powder, they can be removed in advance by using a sedimentation method in which the powder particles are separated by differences in specific gravity, a sieving method in which the powder particles are separated in accordance with particle sizes, or modification of the infiltration process such that the highly electrically conductive material is infiltrated in a skeleton along a predetermined direction while concentrating the impurities into one part of the skeleton. In fact, these additional steps greatly contribute to decreasing the restriking frequency.

A problem arises though when the impurities are dissolved or precipitated in the raw material. These impurities cannot be removed by means of the sedimentation methods, the sieving method or modified infiltration, suggesting that this problematic contamination might have been one of the subtle factors in the occurrence of the restriking phenomenon. Though perfect removal of these impurities is difficult, it is still better to select a raw material containing fewer impurities for solving this problem.

However, according to further strict experiments, nonnegligible imperfection in this manner of controlling the restriking by selection of a less-contaminated raw material began to appear. Namely, even in the case where a powder having no detected impurities is carefully selected for each of the raw Cr and Cu powders, the manufactured Cu-Cr alloy often contains a precipitant, and when applying the precipitated alloy to a vacuum circuit breaker, the restriking phenomenon arises more than in the case of a non-precipitated alloy.

This precipitation is considered to be a product of a reaction between some element dissolved in the raw Cr powder and the surrounding atmosphere at the sintering or infiltrating step. Taking this into consideration, it is further suggested that attention must be paid not only to the existence of mixed impurities and precipitates in the raw material but also to oxide products produced by reaction with oxygen contained in the raw material and the atmosphere.

Based on the above-described knowledge, the inventors have found a technical method of subjecting raw Cr powder to a heat treatment, specifically, a treatment at a temperature within the range of 1,300° C. to slightly below the melting point prior to pulverization. Thus, the obtained Cr powder is very useful for making a contact material that prevents the occurrence of the restriking phenomenon at the contacts.

However, this heat treatment method requires a rather high temperature, and, accordingly, loss of the Cr material is increased by remarkable vaporization. In addition, the manufacturing apparatus is also heavily soiled. Therefore, Further improvement is desired.

In view of the above circumstances, the present inventors propose an improved method for manufacturing a contact material according to the present invention. This method is characterized in that,before manufacturing the Cr-Cu alloy contact material from raw Cr and Cu powders, the raw Cr material is subjected to heat treatment along with a carbon material. According to this improved method, the heat level required for obtaining raw Cr powder suited for preventing the restriking phenomenon can be lowered to a temperature level within the range of 800° C. to 1,400° C. by employing a carbon material.

Here, before offering a detailed explanation of each step of the manufacturing method of the present invention, the preparation of the raw Cr material will be generally described, which, as mentioned before, has an effect throughout the later steps of the manufacturing process.

At present, commercialized techniques of smelting Cr material can be generally classified into two methods. The first method is a reduction method which includes the reduction of a Cr-containing ore such as $FeCr_2O_4$, $MgCr_2O_4$ and the like by using aluminum, silicon, and the like to obtain a reduced Cr metal. The second method is an electrolysis method in which after the Cr-containing ore is dissolved, insoluble non-metal impurities are separated to make an electrolyte solution which is then electrolyzed to obtain an electrolytic Cr metal.

Ordinarily, the reduced Cr metal contains about 1,000 ppm of gaseous impurities such as oxygen and nitrogen, and about 1,000 ppm to 10,000 ppm of non-gaseous impurities such as aluminum, silicon, iron and the like. In contrast, the electrolytic Cr metal contains about 1,000 ppm to 10,000 ppm of gaseous impurities, a remarkably large amount, and about 100 ppm of non-gaseous impurities, a relatively small amount. The Cr metal obtained above is pulverized into a powder having a desired particle size and then used for manufacturing contact material.

In the manufacturing method according to the present invention, the Cr powder obtained by either of the abovedescribed methods is mixed with carbon powder to create a Cr-C mixed powder which is then subjected at least once to heat treatment at a temperature within the range of 800° C. to 1,400° C. in a vacuum or non-oxidizing atmosphere such as a hydrogen atmosphere and the like to obtain a decontaminated Cr material. After that, the decontaminated Cr material is combined with other raw materials to manufacture a contact material. Details of each of the steps in the manufacturing process are explained below.

First, during the decontaminating step, it is preferred that a Cr powder having a particle size within the range of approximately 1 to 250 μm is used as a raw Cr material. This is an important factor for realizing an efficient treatment with carbon powder, because if the raw Cr material is pulverized to the point where the particle size is less than 1 μm, such a Cr powder will have a higher amount of chromium oxide due to the fact that the surface of the Cr particles become easily oxidized from exposure to the surrounding atmosphere. As a result, a larger amount of carbon may have to be added to the Cr powder to satisfactorily remove gaseous oxygenic contaminants, such as oxygen from the Cr powder. In contrast with this, if the raw Cr material has a particle size larger than 250 μm, the carbon cannot act throughout the raw Cr particles. As a result, the oxygen in the raw Cr material cannot be removed completely. Therefore, it is most preferable that the manufacturing process include a pulverization treatment of the raw Cr material such that it reaches a desired particle size within the above-mentioned range before the addition of carbon powder. In this regard, pulverization is desirably carried out In a non-oxidizing atmosphere. In addition, to ensure efficient treatment, it is also preferred that the particle size of the carbon powder used for decontamination be the same size as that of the raw Cr powder.

Next, the Cr and C powders mentioned above are thoroughly mixed. In regard to the mixing ratio of the Cr and C powders, the amount of carbon powder is preferably within the rage of approximately 50 ppm to 5,000 ppm by weight relative to the amount of raw Cr powder in order to efficiently and sufficiently eliminate gaseous oxygenic contaminants from the raw Cr powder. If the carbon content is less than 50 ppm by weight, the removal of gaseous oxygenic contaminants from the raw Cr material will be insufficient, and the contact material manufactured from that Cr material will not be satisfactorily improved in relation to the restriking frequency. In contrast, if the carbon content is more than 5,000 ppm by weight, the elimination of gas contaminants can be satisfactorily carried out. However, an excessive amount of carbon will remain in the Cr material after heat treatment, thereby deteriorating the voltage withstanding property of the Cu-Cr alloy contact material manufactured from that Cr material.

The above-mentioned Cr-C mixed powder is preferably pressed to form a compact before heat treatment. Alternatively, the mixed powder may be held in a vessel. These proceedings are useful for avoidance of material loss by scattering, and also work effectively to prevent a decrease in the decontamination efficiency due to aggregation of the Cr and C powders. Namely, if the Cr-C mixed powder lies in a flowable state during handling, the Cr particles and the C particles in the mixed powder are able to gradually aggregate among themselves and thereby disrupt the even distribution, which then leads to a deterioration of the gas removing efficiency. However, if the mixed powder is compacted at a light pressure or held in a vessel so that it can at least hold its form, it is sufficient for the manufacturing method of the present invention. If compacted, the mixed powder is preferably pressed at a pressure of at most 8 t/cm$^2$. If the compacting pressure exceeds this value, the compact mold is easily damaged, therefore such a high pressure is not economically advisable. Furthermore, an exceedingly high compacting pressure adversely affects the decontamination efficiency during heat treatment.

The mixed powder after being compacted or stored in a vessel is subjected to heat treatment, in which it is sintered for removing oxygenic gas contaminants with the help of the carbon component. The heating temperature is preferably within the range of 800° C. to 1,400° C. If the sintering temperature is lower than 800° C., decontamination of the Cr material is not likely to be completed, and even if it is completed, it would take an exceedingly long time. On the other hand, if the temperature exceeds 1,400° C., decontamination is sufficient, but the Cr material is vigorously vaporized, thereby increasing the material loss of the Cr component and heavily soiling the manufacturing apparatus as well. Further more, since reaction of the Cr component with the carbon component produces trichromium dicarbide $Cr_3C_2$, excess heat over the above-specified temperature range is not preferable.

The sintering atmosphere is preferably a non-oxidizing atmosphere such as a vacuum, a hydrogen atmosphere or the like. The preferred choice is a vacuum above $1\times10^{-5}$ torr because oxygen gas, nitrogen gas and the like can be easily removed from the Cr powder compacted or received in the vessel and the container used for sintering.

The Cr material decontaminated by the above-described heat treatment is then preferably subjected to a pulverization treatment before utilizing it for the manufacturing step, in which it is formed into a powder having a desired particle size for the manufacturing method. The mean particle size of the pulverized Cr powder is preferably limited within the range of 5 to 250 μm to ensure proper electrical properties of the obtained contact material and to effectively perform manufacturing through sintering for example. Namely, if the mean particle size is less than 5 μm, pores are easily formed in a skeleton after having infiltrated with the Cu material and the like, and a contact material obtained by solid-phase sintering (details of which will be described hereinafter) and a large volume of air tends to exist in the contact materials. This is not preferable for the proper electrical properties of the contacts, because it increases the restriking frequency. On the other hand, if the mean particle size is more than 250 μm, the weld resistance, voltage withstanding property and breaking characteristics of the obtained contacts become largely uncertain. Moreover, segregation arises in the contact material, which is not preferable for ensuring reliability of a circuit breaker.

According to the preferred embodiments of the decontamination treatment, the oxygen content of the Cr material can be decreased to a level less than 200 ppm by weight.

The method of manufacturing contact materials for circuit breakers can be generally classified into two methods. Namely, a solid-state sintering method and a infiltration method, and in the manufacturing process it is possible to decrease the gaseous contaminants contained in the raw material somewhat by controlling the heat level during sintering or infiltration. In this connection, if the contact material is manufactured from Cr material containing oxygen gas and nitrogen gas each at an amount of more than 200 ppm by weight, it is difficult to regulate the amount of gaseous contaminants remained in the manufactured contact material to a preferred level of lower than 200 ppm by weight or a desired level of lower than 100 ppm by weight. In the Cu-Cr alloy contact material including more than 200 ppm of gas contaminants (oxygen) by weight, the restriking phenomenon tends to frequently occur. It is therefore preferable to control both the amount of oxygen gas and the amount of nitrogen gas in the pulverized Cr powder to a level lower than 200 ppm. On the other hand, since the gaseous contaminants contained inside time particles of the raw Cr material are removed to a large extent by the above-mentioned heat treatment, it is important to prevent the decontaminated Cr material from absorbing gas contaminants from the surrounding atmosphere again during the pulverization.

To accomplish the above, it is important to prevent the decontaminated Cr material from being heated and oxidized by friction heat generated during pulverization. Therefore, violent pulverizing should be avoided. Moreover, pulverization should preferably be performed in a non-oxidizing atmosphere, especially when the powder has a particle size of 100 μm or less.

Next, the pulverized Cr material proceeds to the manufacturing step. At the manufacturing step, the solid-phase sintering method or infiltration method can be alternatively utilized as mentioned hereinabove. In the solid-phase sintering method, the Cr material powder is mixed with Cu powder for an electrically-conductive component and other component materials, such as a silver powder which is mixed additionally or alternatively at a desired final composition. The mixed powder is then compacted and sintered to obtain a contact material.

If employing the infiltration method for manufacturing the contact material, it is possible to use the decontaminated Cr material without pulverization by controlling the compacting pressure of the Cr-C mixed powder before heat treatment. In other words, the compacting pressure is a factor in determining the Cr content in the Cu-Cr alloy manufactured by the infiltration method.

Specifically, the Cr content in the Cu-Cr alloy material, which may include a silver component additionally or alternatively, can selectively be changed within the range of 20 wt % to 80 wt % by controlling the compacting pressure. The compacting pressure is set to 8 $t/cm^2$ or less, preferably to 7.5 $t/cm^2$ or less, and most preferably 7 $t/cm^2$ or less. If the Cr-C mixed powder is compacted at a pressure of more than 8 $t/cm^2$, the content of the Cr component in the compact material after infiltration exceeds 80 wt %. If the desired Cr content for the infiltrated alloy is comparatively high, around 80 wt %, for example, the above-described manner is usable for making the desired Cr skeleton. However, if the desired content is low, close to 20 wt %, for example, it is difficult to create a skeleton for obtaining such an alloy material by The above manner using only the raw Cr material. In such a case, a necessary amount of Cu powder is added to the raw Cr material and the carbon powder to form a Cr-C-Cu mixed powder and compacted. The compacting pressure in this case is preferably set at a level of 8 $t/cm^2$ or less. If the compacting pressure exceeds this value, the compact tends to crack during heat treatment.

The compact is put into a furnace with a sintering case and subjected to heat treatment. Here, it is to be noted that operation setting of treatment temperature and treatment time both influence the density, also known as the porosity, of the Cr skeleton obtained by sintering. Therefore, the preferred setting must be selected in accordance with the ratio of the content of the Cr component and that of the Cu component in the Cr skeleton infiltrated with the Cu material. For example, if the desired Cr/Cu ratio is approximately 50/50 by weight, the skeleton must be prepared so as to have a porosity within a range of 40 vol % to 50 vol %. In this case, a preferable setting is such that the heating temperature is within the range of 900° C. to 950° C. and the heating period is within the range of 0.1 hour to two hours, or more preferably, a quarter hour to 1 hour.

The Cr skeleton is then mounted on a Cu infiltrate material and heated in a vacuum within the range of $1\times10^{-4}$ torr to $10^{-6}$ torr so that the Cu material melts to infiltrate into the pores of the Cr skeleton, thereby obtaining a final contact alloy material. If necessary, the infiltrate material can additionally or alternatively include another component such as silver and the like in order to produce a final contact material including another component.

The operating temperature is set at the melting point of the infiltrate material or higher. If simple copper is used as the infiltrate material, the operating temperature is preferably set within the range of 1,100° C. to 1,300° C., and when silver is used, it is preferably within the range of 1,000° C. to 1,100° C. The infiltration operation is performed for a sufficient amount of time for the Cu material to infiltrate into the pores throughout the Cr skeleton.

Moreover, it is preferable to form a layer with the infiltrate material on a portion of the surface of the Cr skeleton at the infiltration step, because this makes it possible to facilitate bonding between the obtained contact alloy material and an electrically-conductive bar of a circuit breaker when they are joined to one another by silver soldering or the like.

Through the above-described manufacturing process, it is preferred that each step be performed in a non-oxidizing atmosphere, for example, an inert gas atmosphere such as argon and the like, a hydrogen gas atmosphere, a nitrogen gas atmosphere, a vacuum or the like.

To improve the electrical properties of the manufactured contact material, it is even more preferable to subject the material to another heat treatment during the manufacturing process in addition to the above-mentioned heat treatment for gas decontamination.

The final composition of the contact alloy material obtained by the above-described manufacturing process preferably contains both the Cu component and Cr component at a content within the range of 20 wt % to 80 wt %. The Cu component can be substituted in part or alternatively with another component, such as silver. If the content of the Cr component exceeds 80 wt %, the contact surfaces tend to easily cause the welding phenomenon to occur therebetween due to Joule heat, and they become rough quite easily, which is not preferred because it increases the restriking frequency. In addition to this, such a contact material cannot break contact sufficiently. For example, an electric current of 40 KA at a voltage of 7.2 KV cannot be interrupted. On the other hand, if the content of the Cr component is less than 20 wt %, the contact cannot withstand voltages higher than 40 KV, and arching occurs, causing the contacts to be worn down.

Moreover, to stabilize the electrically-conductive property of the contact material, it is preferred that the ratio of the Cr component part which is solved in the phase of the electrically-conductive component, namely, the Cu component or the alternative Ag component, lie approximately within the range of 0.01 wt % to 0.35 wt %.

EXAMPLES

Referring now to the drawings, preferred embodiments of a process of manufacturing the contact material according to the present invention will be described.

First, a vacuum circuit breaker to which the contact material obtained by the manufacturing process according to the present invention can be applied will be explained with reference to FIGS. 1 and 2.

Figure 2:
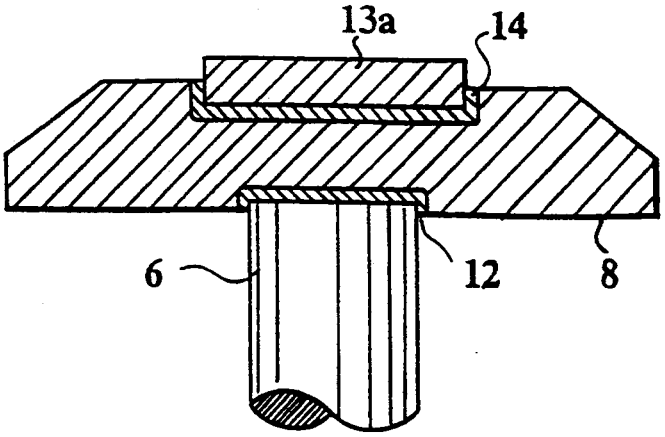
FIG. 2 is an enlarged sectional view showing a contact part incorporated in the circuit breaker shown in FIG. 1.

As shown in FIG. 1, a breaker chamber 1 is constructed with an insulating casing 2 and lid members **4*a* and 4*b*. The insulating casing 2 is formed into an almost cylindrical shape with an insulating material, and the lid members 4***a* and 4*b* are arranged on both ends of the insulating casing 2 via sealing metal members 3*a* and 3*b*, so that the inside of the insulating casing 2 is maintained as an airtight vacuum. In the breaker chamber 1, electrically conductive bars 5 and 6 arc aligned in such a way that their respective ends which lie inside the case are positioned to face each other. A pair of electrodes 7 and 8 are arranged on each of the aligned ends of the bars. The upper electrode 7 corresponds to a fixed electrode, and the lower electrode 8 to a movable electrode. The movable electrode 8 is equipped with bellows 9 so that the movable electrode 8 can be axially moved while maintaining the airtight vacuum in the breaker chamber 1. On the bellows 9, a metal arc shield 10 is provided so as to prevent the bellows from being covered with arching metal vapor. Moreover, a metal arc shield 11 is provided in the breaker chamber 1 so as to cover the electrodes 7 and 8. This arc shield 11 can prevent the arching metal vapor from covering the insulating casing 2. As shown in FIG. 2, which is an enlarged view of a contact part, the electrode 8 is fixed to a soldering portion 12 of the conductive bar 6 with solder. Alternatively, the electrode 8 may be jointed to the conductive bar 6 by caulking the portion 12 with the electrode 8. A contact 13*a* is fixed on the electrode 8 with solder 14. Similarly, a contact 13*b* is attached on the fixed electrode 7.

The contact material according to the present invention is suitable for either of the above-mentioned contacts 13*a* and 13*b*.

In addition, by using the above circuit breaker, the restriking frequency was measured for evaluation with respect to each sample of contact alloy materials prepared in the following Examples and Comparative Examples which will be explained hereinafter. Below is a detailed description of the measurement process.

(Measurement of Restriking Frequency)

A pair of disk-type sample alloy pieces, with each piece having a diameter of 30 mm and a thickness of 5 mm, were attached to electrodes of the above-described demountable type vacuum circuit breaker, respectively, by baking them at a temperature of 450° C. for 30 minutes. It should be noted here that the installment of the sample pieces was not accompanied by the use of solder nor heat for soldering. The circuit breaker was then connected to a circuit of 6 KV×500 A. In this state, the contact was broken repeatedly, 2,000 times, during which the restriking frequency was calculated by counting the number of times restriking took place. Using two different sets of vacuum circuit breakers, six pairs of sample pieces were subjected to the breaking test for each example. A distribution range for the six values of the restriking frequency is shown in the restriking frequency columns of the tables.

Next, a method of manufacturing the contact material employed in each of the examples according to the present invention will be explained.

First, for preparation of sample Cr powders used for manufacturing a contact alloy material, a raw high-carbon ferrochromium material was dissolved in sulfuric acid to obtain a solution. This solution was then treated by an electrolytic method to form a metal Cr plate. The metal Cr was then pulverized by a crusher to obtain a coarse Cr powder having a particle size of approximately 0.5 mm to 2 mm. The coarse powder was used for preparing the following Samples A through L.

Sample A

The coarse Cr powder obtained above was further pulverized by a grinder, and then sieved with a vibrating screen to separate a raw Cr powder having a mean particle size within the range of 1 μm to 250 μm. The raw Cr powder was further sieved to create Sample A, a Cr powder having a mean particle size within the range of 5 μm to 250 μm.

Samples B, C, D, E and F

A portion of the Cr powder of Sample A was mixed adequately with a carbon powder having approximately the same particle size as that of the Cr powder of Sample A at a carbon content of 10 ppm by weight by using a mixer, thereby obtaining the Cr-C mixed power of Sample B.

In the same way, the Cr-C mixed powders of Samples C, D, E and F were prepared by using the Cr powder of Sample A and by changing the carbon content with which it was mixed to 50 ppm (Sample C), 1,000 ppm (Sample D), 5,000 ppm (Sample E) and 30,000 ppm (Sample F) by weight, respectively.

Samples G, H, I, J, K and L

Another portion of the Cr powder of Sample A was subjected to heat treatment for decontamination in which the compacts were heated at a temperature of 1,300° C. for 1 hour in vacuum of about $2\times10^{-5}$ torr. The sintered compact was then pulverized for 12 hours in a grinder which was enclosed in a nitrogen atmosphere, thereby obtaining Sample G, a decontaminated Cr powder having a mean particle size of 70 μm.

On the other hand, with respect to the Cr-C mixed powders of Samples B, C, D, E and F, a portion of each mixed powder was compacted individually at a compacting pressure of 1 t/cm$^2$ by using a briquet machine to form a sample Cr-C compact. Each compact was then subjected to heat treatment and pulverized in a manner similar to Example G to obtain the Cr powders of Samples H, I, J and K, respectively.

The oxygen content of the above sample powders was measured in accordance with the measuring method which are described below in detail.

(Measurement of the oxygen content)

Before taking any measurement, for cleaning purposes, a graphite crucible was heated at a temperature of about 3,000° C. Then, in accordance with the inert gas fusion method, a sample, which had bee cleaned by washing it with acetone in a case of a solid sample, was placed on the crucible and heated at a temperature of approximately 2,500° C. for a period of 25 seconds, during which oxygen element in the sample was discharged in the form of carbon monoxide and detected by using infrared absorption analysis. The oxygen content corresponding to the amount of the oxygenic gaseous contaminants in the sample was determined by comparing the obtained result with that of a standard sample according to Japanes Steel Standard No. GS-1C.

The measurement results of the above sample powders A through L are shown in Table 1.

As is clearly shown in Table 1, the Cr powder and Cr-C mixed powders which did not undergo heat treatment, specifically, the powder of Sample No. 1 and the mixed powders of Samples B, C, D, E and F, contain a few thousand ppm by weight of oxygen. On the other hand, for the Cr powders which underwent heat treatment, specifically, the powders of Samples G, H, I, J, K and L, the oxygen content is lower. For the powders of Samples I, J and K, which have been heat-treated with a carbon material added at an amount within the range of 50 to 5,000 ppm by weight, the oxygen content is dramatically reduced, reaching the range of 20 ppm to 110 ppm by weight. For the powder of Sample H, which has been treated with 10 ppm by weight of a carbon material, the value of the oxygen content varies widely within the range of 270 ppm to 1,200 ppm by weight. By contrast, the oxygen content of the powder of Sample L, which has been treated with 10,000 ppm by weight of a carbon material, tends to increase. This increase is considered to be due to gas absorbed in the raw carbon material.

Second, using the Cr powders and the Cr-C mixed powders of Samples A through L obtained above, a contact alloy material was manufactured by using the infiltration method in each of the following Examples and Comparative Examples.

Comparative Example Nos. 1 to 7 and Example Nos. 1 to 5

The Cr powder of Sample A was put into a vessel made of carbon, and sintered at a temperature of 1,050° C. in a vacuum of $7\times10^{-6}$ torr for 1 hour to obtain a Cr skeleton. Then, a Cu infiltration material was infiltrated into pores of the Cr skeleton at a temperature of 1,150° C. in a vacuum of $2\times10^{-5}$ torr for 1 hour to obtain the Cu-Cr alloy material of Comparative Example No. 1, which includes a Cu component at a content of about 50 wt %.

Similarly, the Cu-Cr alloy materials of Comparative Example Nos. 2 to 7 and Example Nos. 1 to 5 were prepared from the Cr-C mixed powders of Samples B through F and the Cr powders of Samples G through L, respectively, by the infiltration method. Also, these alloy materials include a Cu component at a content level of about 50 wt %.

The oxygen content and restriking frequency of the Cu-Cr alloy materials obtained above were measured, and the results are shown in Table 2.

In Comparative Example No. 1, since the Cr powder used contains a large amount of oxygen, the obtained alloy material still contains oxygen at a level of about 1,000 ppm by weight, and its restriking frequency lies at the high level of a few percent, similarly, in Comparative Example Nos. 2 to 6, there is little improvement.

By comparison, since the oxygen content of the Cr powder used is low, the oxygen content and restriking frequency of the obtained alloy material in Comparative Example No. 7 are lower than those of the above mentioned Comparative Examples. Moreover, these improvements are intensified by the existence of a carbon material during heat treatment of the Cr powder as shown by the results of Example Nos. 1 to 5, and are remarkable when the carbon content is within a range of 50 ppm to 5,000 ppm by weight. In this range, the oxygen content of the alloy material is less than 100 ppm by weight and the restriking frequency is less than 0.001%. By contrast, when the carbon content is lower than this range, meaning that the decontamination effect of the carbon is insufficient, the restriking phenomenon occurs rather frequently. On the other hand, when the carbon content exceeds the above range, the distribution range of the oxygen content of the alloy material widens, and the restriking phenomenon still occurs frequently. It is considered that this occurrence is due to excess carbon, a portion of which is precipitated at the contacting surface or discharged into the space between the electrodes.

As a result, the restriking frequency can be decreased effectively by subjecting the raw Cr powder with carbon powder to heat treatment. In this connection, the preferred carbon content exists within the range of 50 ppm to 5,000 ppm by weight.

Third, using the Cr powders and Cr-C mixed powders of Samples A through L obtained above, a contact alloy material was manufactured by the solid-phase sintering method in each of the following Examples and Comparative Examples.

Comparative Example Nos. 8 to 14 and Example Nos. 6 to 10

The Cr powder of Sample A was put into a ball mill enclosed with an argon gas. Next, a reduced Cu powder was added to the Cr powder at a mixing ratio of 1/1 by weight, and stirred for 12 hours. The reduced Cu powder was obtained by subjecting a Cu powder having a particle size of 44 μm to a reduction treatment in which it was heated at a temperature of 400° C. for 1 hour in a hydrogen atmosphere. The mixed powder was then pressed at a compacting pressure of 4 t/cm$^2$ to form a compact. The obtained compact was sintered at a temperature of 1,030° C. for 2 hours in a hydrogen atmosphere, and cold pressed at a pressure of 8 t/cm$^2$. The compact was further sintered at a temperature of 1,030° C. for 1 hour in a vacuum of $2\times10^{-6}$ torr to obtain the Cu-Cr alloy material of Comparative Example No. 8, which includes a Cu component at a content of about 50 wt %.

Similarly, the Cu-Cr alloy materials of Comparative Example Nos. 9 to 14 and Example Nos. 6 to 10 were prepared using the Cr-C mixed powders of Samples B through F and the Cr powders of Samples G through L, respectively, by the above-described solid-phase sintering method. These alloy materials also include the Cu component at a content of about 50 wt %.

The oxygen content and restriking frequency of the Cu-Cr alloy materials obtained above were measured in the same manner as that for Example Nos. 1 to 5, and the results are shown in Table 3.

As can be seen from the measurements, the restriking frequencies of the alloy materials of Comparative Example Nos. 8 to 13, which were obtained from the sample powders containing a large amount of oxygen (the alloy of which contain oxygen at a level of about 1,000 ppm by weight), are also at a level of a few percent or more. By comparison, the levels of oxygen content and restriking frequency are reduced for the Cu-Cr alloy materials of Example Nos. 6 to 10, which were obtained from the sample powders heat-treated with a carbon powder. This effect is especially exhibited at a carbon content within the range of 50 ppm to 5,000 ppm by weight, as can be seen in Example Nos. 7 to 9. In this range, the oxygen content of the alloy material is less than 100 ppm by weight and the restriking frequency is less than 0.001%. Therefore, it is apparent that this effect is due to the existence of the carbon material during heat treatment for decontamination. However, if the carbon content is lower than the preferred range stated above, the effect is insufficient, and if the carbon content is higher than the preferred range, the distribution range of the oxygen content of the alloy material widens, thus giving rise to a frequently occurring restriking phenomenon. It is considered that this unfavorable result is additionally due to excess carbon.

Accordingly, it is realized that a similar effect can be obtained with regards to preventing the restriking phenomenon by using either the infiltration method or the solid-phase sintering method according to the present invention. Therefore, the Cr powder prepared using the above-mentioned characteristic decontamination treatment is a very useful material for manufacturing Cu-Cr alloy contact materials.

The decontaminated Cr material according to the present invention can also be used for manufacturing alloy materials containing another component, for example, an ingredient added as a weld inhibitor such as bismuth or tellurium or an alternative component to the Cu component, while still producing similar effects. The following is an example of modification through manufacturing by the solid-phase sintering method.

Example Nos. 11 to 18

First, raw Cu powder was subjected to reduction treatment by heating it at a temperature of 450° C. for 2 hours in a hydrogen gas atmosphere having a purity such that the dew point was −70° C., and then put into a ball mill enclosed with nitrogen gas. Next, decontaminated Cr powder from Sample J and Bi powder were added to the Cr powder at a ratio such that a material loss due to heat during the following step was expected for the amount of added Bi powder in order to obtain a final alloy material containing 10 wt % of a Cr component and 0.1 wt % of a Bi component, and milled for 6 hours. Then, the mixed Cu-Cr-Bi powder was repeatedly subjected to several treatments of compacting or coining at a pressure of 10 t/cm$^2$ and sintering at a temperature of 1,020° C. for an hour, thereby obtaining the Cu-Cr-Bi alloy material of Example No. 11.

Similarly, the Cu-Cr-Bi alloy materials of Example Nos. 12 to 16 were prepared by changing the mixing ratio so that the Cr content in the alloy becomes 20 wt % (Example No. 12), 50 wt % (Example No. 13), 80 wt % (Example No. 14), 90 wt % (Example No. 15) and 50 wt % (Example No. 16), respectively. The Bi content were set at 0.1 wt % for Example Nos. 13 and 15, 0.2 wt % for Example Nos. 12 and 14), and 0.5 wt % for Example No. 16. For Example Nos. 17 and 18, the Bi powder was replaced by a Te powder or mixture thereof.

Similarly, the oxygen content and restriking frequency of the above-mentioned Cu-Cr-Bi, Cu-Cr-Te and Cu-Cr-Bi-Te alloy materials of Example Nos. 11 to 18 were measured, and the results are shown in Table 4.

In Table 4, as illustrated by Example Nos. 13 and 16, the effect of the decontaminated Cr powder can be seen distinctly, Irrespective of the Bi content. Moreover, the same effect appears when 5% by weight of a Te powder or a Bi-Te mixture is used in place of the Bi component in Example Nos. 17 and 18. Thus, utilization of the decontaminated Cr powder can be regarded as being effective in a wide range of contents with respect to all of the components. However, when the Cr content is extremely low, such as 10% by weight for Example No. 11, the contacting surface of the contact tends to easily become rough when contact is broken, thereby causing a decrease in its resistance to arching. Moreover, when the Cr content is exceedingly high, such as 90 wt % for Example No. 15, a welding phenomenon arises on the contact even when a weld inhibitor or a Bi component is present, which slightly changes the condition of the contacting surface and results in fluctuation of the restriking frequency.

The effect by the decontaminated Cr material mentioned above can be obtained through a manufacturing process using the infiltration method as well. The following is an example of modification through the infiltration method with a weld inhibitor ingredient.

Example No. 19

First, a Cr powder having a particle size of about 70 μm, prepared from the Cr powder of Sample A by sieving, was mixed with a carbon powder at a carbon ratio of 1,000 ppm by weight and poured into a carbon vessel. Next, without being compressed, the mixed powder was subjected to heat treatment at a temperature of 1,370° C. in a vacuum of $1.5\times10^{-5}$ torr to obtain a decontaminated Cr block. Then, the decontaminated Cr block was pulverized in a grinder enclosed in an argon atmosphere, thereby obtaining the decontaminated Cr powder of Sample M having a mean particle size of 44 μm. Using this decontaminated Cr powder, a Cr skeleton was prepared by a method similar to that used for Comparative Example No. 1.

To prepare an infiltration material, a pure Cu material was melted in a vacuum of $1.6\times10^{-4}$ torr, to which was added a Bi material to obtain a Cu-Bi alloy. This Cu-Bi infiltration material was then infiltrated into pores of the above-obtained Cr skeleton in a hydrogen atmosphere whose purity was such that it had a dew point of −65° C., so as to create the Cu-Cr-Bi alloy material of Example No. 19 containing 0.1 wt % of the Bi component and 50 wt % of the Cr component.

The results of measurements taken for Example No. 19 are shown in Table 4. In this example, it can be seen that a similar effect can be obtained when using a Cu-Cr-Bi alloy material manufactured by the infiltration method.

Example Nos. 20 and 21

A pure Ag infiltration material was infiltrated into the pores of a Cr skeleton having a porosity of about 50% which was obtained using a similar manner to that used for Example No. 19, at a temperature of 1,050° C. in a vacuum of $5\times10^{-5}$ torr, thereby obtaining the infiltrated Cr-Ag alloy material of Example No. 20 containing 50 wt % of the Cr component.

Similarly, an infiltration material composed of 72 wt % of silver and balance copper was infiltrated into the pores of a Cr skeleton having the same porosity as above at a temperature of 970° C. in a vacuum of $2\times10^{-5}$ torr to obtain the infiltrated 50 Cr-36 Cu-14 Ag alloy material of Example No. 21.

The results of measurements taken for Example Nos. 20 and 21 are shown in Table 4. According to these examples, it is clear that similar effects of the present invention can be produced when using a silver alloy material.

From the above embodiments, the contact materials manufactured by the method according to the present invention have excellent circuit breaking characteristics through either a solid-state sintering method or an infiltration method. Namely, the restriking frequency can be decreased, and the distribution range of the values of the restriking frequency can be narrowed. Moreover, it must be clearly understood that the present invention can be successfully applied not only to the manufacture of Cu-Cr alloy materials but for producing alloy materials containing other elements. Namely, silver can be employed as an alternative component and weld inhibitor ingredients such as bismuth, tellurium and the like can be additionally employed.

Moreover, It must be clearly understood that the Cu-Cr alloy material improved according to the present invention can be also successfully utilized not only as a contuct material but for other electrical parts because of its prominent electrical properties.

Finally, it must be understood that the invention is in no way limited to the above embodiments and that many changes may be brought about therein without departing from the scope of the invention as defined by the appended claims.

TABLE 1

| Sample | Content of Added Carbon (ppm by wt.) | Heat Treatment for Decontamination | Oxygen Content of Sample Powder (ppm by wt.) |
|---|---|---|---|
| A | — | — | 4,500–9,000 |
| B | 10 | — | 4,500–9,000 |
| C | 50 | — | 4,500–9,000 |
| D | 1,000 | — | 5,000–10,000 |
| E | 5,000 | — | 5,000–10,000 |
| F | 10,000 | — | 6,000–12,000 |
| G | — | Subjected | 210–1,800 |
| H | 10 | Subjected | 270–1,200 |
| I | 50 | Subjected | 40–110 |
| J | 1,000 | Subjected | 20–80 |
| K | 5,000 | Subjected | 25–70 |
| L | 10,000 | Subjected | 100–600 |
| M | 1,000 | Subjected | 20–80 |

TABLE 2

| | Used Cr Sample | | Obtained Cu—Cr Alloy Contact Material | |
|---|---|---|---|---|
| | Sample | Oxygen Content (ppm by wt.) | Oxygen Content (ppm by wt.) | Restriking Frequency (%) |
| Comparative Example 1 | A | 4,500–9,000 | 970–2,400 | 1.8–5.4 |
| Comparative Example 2 | B | 4,500–9,000 | 1,050–2,700 | 2.4–3.8 |
| Comparative Example 3 | C | 4,500–9,000 | 990–3,000 | 2.0–4.0 |
| Comparative Example 4 | D | 5,000–10,000 | 810–2,500 | 1.6–3.8 |
| Comparative Example 5 | E | 5,000–10,000 | 920–2,600 | 2.6–4.6 |
| Comparative Example 6 | F | 6,000–12,000 | 1,200–3,550 | 2.8–6.4 |
| Comparative Example 7 | G | 210–1,800 | 400–1,350 | 1.2–3.6 |
| Example 1 | H | 270–1,200 | 180–1,900 | 0.8–4.6 |
| Example 2 | I | 40–110 | 30–75 | <0.001 |
| Example 3 | J | 20–80 | 35–70 | <0.001 |
| Example 4 | K | 25–70 | 20–44 | <0.001 |
| Example 5 | L | 100–600 | 40–350 | 0.6–5.2 |

TABLE 3

| | Used Sample Cr | | Obtained Cu—Cr Alloy Contact Material | |
|---|---|---|---|---|
| | Sample | Oxygen Content (ppm by wt.) | Oxygen Content (ppm by wt.) | Restriking Frequency (%) |
| Comparative Example 8 | A | 4,500–9,000 | 1,550–5,200 | 1.8–6.4 |
| Comparative Example 9 | B | 4,500–9,000 | 1,400–3,500 | 2.8–5.8 |
| Comparative Example 10 | C | 4,500–9,000 | 1,300–3,600 | 2.8–6.2 |
| Comparative Example 11 | D | 5,000–10,000 | 1,130–3,250 | 3.4–8.2 |
| Comparative Example 12 | E | 5,000–10,000 | 1,100–3,640 | 3.0–6.4 |
| Comparative Example 13 | F | 6,000–12,000 | 1,400–4,610 | 3.8–8.8 |
| Comparative Example 14 | G | 210–1,800 | 480–2,220 | 1.6–4.2 |
| Example 6 | H | 270–1,200 | 200–2,000 | 0.1–5.2 |
| Example 7 | I | 40–110 | 35–90 | <0.001 |
| Example 8 | J | 20–80 | 42–85 | <0.001 |
| Example 9 | K | 25–70 | 25–55 | <0.001 |
| Example 10 | L | 100–600 | 45–475 | 0.8–8.0 |

TABLE 4

| | Used Sample Cr | | | Obtained Alloy Contact Material | | |
|---|---|---|---|---|---|---|
| | Sample | Oxygen Content (ppm by wt.) | Manufacturing Method | Composition (by wt %) | Oxygen Content (ppm by wt.) | Restriking Frequency (%) |
| Example 11 | J | 20–80 | Solid-Phase Sintering | 10Cr—Cu—0.1Bi | 30–80 | 0.1–4.2 |
| Example 12 | J | 20–80 | Solid-Phase Sintering | 20Cr—Cu—0.2Bi | 40–100 | <0.001 |
| Example 13 | J | 20–80 | Solid-Phase Sintering | 50Cr—Cu—0.1Bi | 45–90 | <0.001 |
| Example 14 | J | 20–80 | Solid-Phase Sintering | 80Cr—Cu—0.2Bi | 140–200 | <0.001 |
| Example 15 | J | 20–80 | Solid-Phase Sintering | 90Cr—Cu—0.1Bi | 140–200 | 0.01–2.4 |
| Example 16 | J | 20–80 | Solid-Phase Sintering | 50Cr—Cu—0.5Bi | 70–160 | 0.01–0.1 |
| Example 17 | J | 20–80 | Solid-Phase Sintering | 50Cr—Cu—5Te | 90–190 | 0.01–0.1 |
| Example 18 | J | 20–80 | Solid-Phase Sintering | 50Cr—Cu—0.2Bi—4.8Te | 80–185 | 0.01–0.1 |
| Example 19 | M | 20–80 | Infiltration | 50Cr—Cu—0.1Bi | 30–60 | <0.001 |
| Example 20 | M | 20–80 | Infiltration | 50Cr—Ag | 43–82 | <0.001 |

TABLE 4-continued

| | Used Sample Cr | | | Obtained Alloy Contact Material | | |
|---|---|---|---|---|---|---|
| | Sample | Oxygen Content (ppm by wt.) | Manufacturing Method | Composition (by wt %) | Oxygen Content (ppm by wt.) | Restriking Frequency (%) |
| Example 21 | M | 20-80 | Infiltration | 50Cr—36Cu—14Ag | 37-75 | <0.001 |

What is claimed is:

1. A process of manufacturing a contact forming material comprising a chromium component and a base component which comprises at least one element selected from the group consisting of copper and silver, comprising the steps of:

(A) subjecting a chromium material in combination with a carbon material at a ratio of the carbon material to the chromium material within the range of approximately 50 ppm to 5000 ppm by weight to a heat treatment in order to decrease the oxygen content of the chromium materials so that the contact forming material manufactured in subsequent step (B) contains no more than 200 ppm by weight oxygen; and (B) preparing said contact forming material from said chromium material of step (A) and from the raw material for a base component so that said product contact forming material has a first phase containing said heat treated chromium material and a second phase containing the base component.

2. The manufacturing process of claim 1, wherein the chromium material is heated in the heat treatment step (A) to a temperature within the range of 800° C. to 1,400° C.

3. The manufacturing process of claim 1, wherein the chromium material is treated in a non-oxidizing atmosphere.

4. The manufacturing process of claim 3, wherein the non-oxidizing atmosphere is a vacuum at a pressure of above $1\times10^{-5}$ torr.

5. The manufacturing process of claim 1, further comprising, before the heat treatment step (A), the steps of:

pulverizing the chromium material and the carbon material; and mixing the pulverized chromium material with the pulverized carbon material so that the carbon material can easily act on the chromium material, thereby obtaining a mixture of the chromium material and the carbon material.

6. The manufacturing process of claim 5, wherein the chromium material pulverized in the pulverizing step has a mean particle size within the range of 1 μm to 250 μm.

7. The manufacturing process of claim 5, further comprising, before the heat treatment step (A), the step of:

compacting the mixture prepared in the mixing step.

8. The manufacturing process of claim 7, wherein the compacting pressure of the compacting step is not more than 8 t/cm$^2$.

9. The manufacturing process of claim 7, wherein the compacting pressure is controlled so that the chromium material after the heat treatment step (A) forms a porous chromium skeleton, the chromium skeleton which permits to be infiltrated with the raw material for the base component in step (B).

10. The manufacturing process of claim 1, further comprising the steps of:

powdering the chromium material obtained in the heat treatment step (A) so as to prepare a Cr material having a mean particle size within the range of approximately 5 μm to 250 μm.

11. The manufacturing process of claim 10, wherein step (B) comprises the steps of:

mixing the powdered chromium material with the raw material for the base component; and sintering the mixed chromium material and the raw material to produce an alloy material.

12. The manufacturing process of claim 1, wherein the content of the chromium component is within the range of approximately 20% to 80% by weight.

13. The manufacturing process of claim 1, wherein the content of the base component is within the range of approximately 20% to 80% by weight.

14. The manufacturing process of claim 11, wherein the alloy material further contains an additive component comprising at least one element selected from the group consisting of bismuth and tellurium.

15. In a process for manufacturing a contact forming material comprising a chromium component and a base component which comprises at least one element selected from the group consisting of copper and silver, including a first phase containing the chromium component and a second phase containing the base component, by using a chromium material and a base component material, the improvement comprising:

subjecting a chromium material in combination with a carbon material at a ratio of the carbon material to the chromium material within the range of approximately 50 ppm to 5000 ppm by weight to a heat treatment in order to decrease the oxygen content of the chromium materials so that the contact forming material manufactured by using the chromium material contains no more than 200 ppm by weight oxygen.

* * * * *